US010741378B2

(12) United States Patent
Hager

(10) Patent No.: US 10,741,378 B2
(45) Date of Patent: Aug. 11, 2020

(54) RF/DC FILTER TO ENHANCE MASS SPECTROMETER ROBUSTNESS

(71) Applicant: DH Technologies Development PTE Ltd., Singapore (SG)

(72) Inventor: James W. Hager, Mississauga (CA)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

(21) Appl. No.: 15/559,539

(22) PCT Filed: Mar. 22, 2016

(86) PCT No.: PCT/IB2016/051611

§ 371 (c)(1),
(2) Date: Sep. 19, 2017

(87) PCT Pub. No.: WO2016/157032

PCT Pub. Date: Oct. 6, 2016

(65) Prior Publication Data

US 2018/0096832 A1 Apr. 5, 2018

Related U.S. Application Data

(60) Provisional application No. 62/141,466, filed on Apr. 1, 2015.

(51) Int. Cl.

| | |
|---|---|
| ***H01J 49/42*** | (2006.01) |
| ***H01J 49/06*** | (2006.01) |
| ***H01J 49/26*** | (2006.01) |

(52) U.S. Cl.

CPC ..... *H01J 49/421* (2013.01); *H01J 49/063* (2013.01); *H01J 49/26* (2013.01)

(58) Field of Classification Search

CPC ..... H01J 49/26; H01J 49/063; H01J 49/421
USPC ..... 250/281, 282, 288
See application file for complete search history.

(56) References Cited

U.S. PATENT DOCUMENTS

| | | | | |
|---|---|---|---|---|
| 5,349,186 | A | 9/1994 | Ikonomou et al. | |
| 8,426,804 | B2 * | 4/2013 | Badiei | H01J 49/005 250/281 |
| 2005/0127283 | A1 | 6/2005 | Morriott | |
| 2007/0138383 | A1 | 6/2007 | Dowell et al. | |
| 2009/0095898 | A1 | 4/2009 | Collings et al. | |
| 2015/0364309 | A1 * | 12/2015 | Welkie | H01J 49/062 250/282 |

FOREIGN PATENT DOCUMENTS

WO 2013114196 A1 8/2013

OTHER PUBLICATIONS

International Search Report and Written Opinion for PCT/IB2016/051611 dated Jul. 4, 2016.

* cited by examiner

*Primary Examiner* — Nicole M Ippolito
*Assistant Examiner* — Hanway Chang

(57) ABSTRACT

Systems and methods described herein utilize a multipole ion guide that can receive ions from an ion source for transmission to downstream mass analyzers, while preventing unwanted/interfering/contaminating ions from being transmitted into the high-vacuum chambers of mass spectrometer systems. In various aspects, RF and/or DC signals can be provided to auxiliary electrodes interposed within a quadrupole rod set so as to control or manipulate the transmission of ions from the multipole ion guide.

19 Claims, 7 Drawing Sheets

RF/DC FILTER TO ENHANCE MASS SPECTROMETER ROBUSTNESS

RELATED APPLICATIONS

This application claims the benefit of priority from U.S. Provisional Application Ser. No. 62/141,466, filed on Apr. 1, 2015, the entire contents of which is hereby incorporated by reference.

FIELD

The invention relates to mass spectrometry, and more particularly to methods and apparatus utilizing a multipole ion guide for transmitting ions.

INTRODUCTION

Mass spectrometry (MS) is an analytical technique for determining the elemental composition of test substances with both quantitative and qualitative applications. For example, MS can be used to identify unknown compounds, to determine the isotopic composition of elements in a molecule, and to determine the structure of a particular compound by observing its fragmentation, as well as to quantify the amount of a particular compound in the sample.

In mass spectrometry, sample molecules are generally converted into ions using an ion source and then separated and detected by one or more mass analyzers. For most atmospheric pressure ion sources, ions pass through an inlet orifice prior to entering an ion guide disposed in a vacuum chamber. In conventional mass spectrometer systems, a radio frequency (RF) signal applied to the ion guide provides collisional cooling and radial focusing along the central axis of the ion guide as the ions are transported into a subsequent, lower-pressure vacuum chamber in which the mass analyzer(s) are disposed. Because ionization at atmospheric pressure (e.g., by chemical ionization, electrospray) is generally a highly efficient means of ionizing molecules within the sample, ions of analytes of interests, as well as interfering/contaminating ions and neutral molecules, can be created in high abundance. Though it may be desirable to increase the size of the inlet orifice between the ion source and the ion guide to increase the number of ions of interest entering the ion guide (thereby potentially increasing the sensitivity of MS instruments), such a configuration can likewise allow more unwanted molecules to enter the vacuum chamber and potentially downstream mass analyzer stages located deep inside high-vacuum chambers where trajectories of the ions of interest are precisely controlled by electric fields. Transmission of undesired ions and neutral molecules can foul/contaminate these downstream elements, thereby interfering with mass spectrometric analysis and/or leading to increased costs or decreased throughput necessitated by the cleaning of critical components within the high-vacuum chamber(s). Because of the higher sample loads and contaminating nature of the biologically-based samples being analyzed with current day atmospheric pressure ionization sources, maintaining a clean mass analyzer remains a critical concern.

Accordingly, there remains a need for improved methods and systems for reducing contamination in downstream mass analyzers.

SUMMARY

In accordance with an aspect of various embodiments of the applicant's teachings, there is provided a mass spectrometer system comprising an ion source for generating ions and an ion guide chamber having an inlet orifice for receiving the ions generated by the ion source and at least one exit aperture for transmitting ions from the ion guide chamber into a vacuum chamber that houses at least one mass analyzer (e.g., triple quadrupoles, linear ion traps, quadrupole time of flights, Orbitrap or other Fourier transform mass spectrometers, etc.). In accordance with various aspects, the ion guide chamber can be maintained at a pressure in a range from about 1 mTorr to about 10 mTorr, while the vacuum chamber can be maintained at a lower pressure (e.g., less than $1\times10^{-4}$ Torr, about $5\times10^{-5}$ Torr), all by way of non-limiting example. In some aspects, the ion guide chamber can be maintained at a pressure such that pressure×length of the quadrupole rods is greater than $2.25\times10^{-2}$ Torr-cm. The system can also comprise a multipole ion guide disposed in the ion guide chamber, the multipole ion guide comprising: i) a quadrupole rod set extending from a proximal end disposed adjacent the inlet orifice to a distal end disposed adjacent the exit aperture, the quadrupole rod set comprising a first pair of rods and a second pair of rods, wherein each rod is spaced from and extends alongside a central longitudinal axis, and ii) a plurality of auxiliary electrodes (e.g., T-shaped electrodes) spaced from and extending alongside the central longitudinal axis along at least a portion of the quadrupole rod set (e.g., the length of the auxiliary electrodes if less than about 50%, less than about 33%, less than about 10% of the length of the quadrupole rod set). In various aspects, the plurality of auxiliary electrodes are interposed between the rods of the quadrupole rod set such that the auxiliary electrodes are separated from one another by a rod of the quadrupole rod set and such that each of the auxiliary electrodes is adjacent to a single rod of the first pair of rods and a single rod of the second pair of rods. In various aspects, the system also comprises a power supply coupled to the multipole ion guide operable to provide a first RF voltage to the first pair of rods at a first frequency and in a first phase, a second RF voltage to the second pair of rods at a second frequency equal to the first frequency and in a second phase opposite to the first phase, and a substantially identical auxiliary electrical signal to each of the auxiliary electrodes. By way of example, the power supply can comprise a first voltage source operable to provide the first RF voltage to the first pair of rods, a second voltage source operable to provide the second RF voltage to the second pair of rods, and at least one auxiliary RF voltage source operable to provide an RF voltage and/or DC voltage to the auxiliary electrodes. In various embodiments, the multipole ion guide can function as Q0 in a mass spectrometer system.

In accordance with various aspects of the present teachings, the auxiliary electrical signal can be a DC voltage that is different from the DC offset voltage at which the quadrupole rod set is maintained. In some related aspects, for example, the system can also comprise a controller configured to i) adjust the DC voltage provided to the auxiliary electrodes so as to attenuate ions transmitted from the multipole ion guide; ii) adjust the DC voltage provided to the auxiliary electrodes so as to adjust a m/z range of ions transmitted from the multipole ion guide; and/or iii) adjust at least one of the first RF voltage provided to the first pair of rods, the second RF voltage applied to the second pair of rods, and the DC voltage provided to the auxiliary electrodes such that substantially no ions are transmitted into the vacuum chamber (e.g., stop transmission from the multipole ion guide through the exit aperture). For example, by adjusting the voltages, the multipole ion guide can be configured to transmit less than 5%, less than 2%, less than 1%, or 0% of ions received from the ion source.

In accordance with various aspects of the present teachings, the auxiliary electrical signal can additionally or alternatively comprise an RF signal, e.g., an RF voltage at a third frequency (e.g., different than the first frequency) and in a third phase. In related aspects, the auxiliary electrical signal can comprise both an RF signal and a DC voltage different from a DC offset voltage at which the quadrupole rod set is maintained.

In various aspects, the power supply can be further operable to provide a supplemental electrical signal to at least one of the rods of the quadrupole rod set, the supplemental electrical signal being one of a DC voltage and/or an AC excitation signal. By way of example, the power supply can be operable to provide a supplemental electrical signal to the quadrupole rod set so as to generate a dipolar DC field, a quadrupolar DC field, or resonance excitation using a supplementary AC field that is resonant or nearly resonant with some of the ions in the ion beam.

The auxiliary electrodes can have a variety of configurations in accordance with various aspects of the present teachings. By way of example, the auxiliary electrodes can be round or T-shaped. In some aspects, the T-electrodes can have a constant T-shaped cross sectional area along their entire length. In various aspects, the auxiliary electrodes can have a length less than half of the length of the quadrupole rod set (e.g., less than 33%, less than 10%), and can be disposed at various locations along the length of the quadrupole rod set (e.g., in one or more of the proximal third, the middle third, or the distal third of the quadrupole rod set). In some aspects, the system can comprise two sets of auxiliary electrodes axially offset from one another along the length of the quadrupole rod set. In related aspects, for example, the power supply can be operable to provide a substantially identical second auxiliary electrical signal to each of the electrodes of the second set of auxiliary electrodes, wherein the second auxiliary electrical signal is different from the auxiliary signal provided to the first set of auxiliary electrodes. By way of non-limiting example, the auxiliary signal applied to the first set of auxiliary electrodes can comprise a DC voltage that is different from the DC offset voltage at which the quadrupole rod set is maintained, while the second auxiliary signal can comprise an RF signal.

In accordance with various aspects of certain embodiments of the applicant's teachings, a method of processing ions is provided comprising receiving ions generated by an ion source through an inlet orifice of an ion guide chamber and transmitting ions through a multipole ion guide disposed in the ion guide chamber, the multipole ion guide comprising: i) a quadrupole rod set extending from a proximal end disposed adjacent the inlet orifice to a distal end disposed adjacent an exit aperture of the ion guide chamber, the quadrupole rod set comprising a first pair of rods and a second pair of rods, wherein each rod is spaced from and extends alongside a central longitudinal axis, and ii) a plurality of auxiliary electrodes spaced from and extending alongside the central longitudinal axis along at least a portion of the quadrupole rod set. The plurality of auxiliary electrodes can be interposed between the rods of the quadrupole rod set such that the auxiliary electrodes are separated from one another by a rod of the quadrupole rod set and such that each of the auxiliary electrodes is adjacent to a single rod of the first pair of rods and a single rod of the second pair of rods. The method can also comprise applying a first RF voltage to the first pair of rods at a first frequency and in a first phase, applying a second RF voltage to the second pair of rods at a second frequency equal to the first frequency and in a second phase opposite to the first phase, and applying a substantially identical auxiliary electrical signal to each of the auxiliary electrodes. Ions can be transmitted from the multipole ion guide through the exit aperture into a vacuum chamber housing at least one mass analyzer (e.g., triple quadrupoles, linear ion traps, quadrupole time of flights, Orbitrap or other Fourier transform mass spectrometers, etc.). In some aspects, the method can also comprise maintaining the ion guide chamber at a pressure in a range from about 1 mTorr to about 10 mTorr, which can be higher than the pressure at which the downstream vacuum chamber is maintained (e.g., less than $1\times10^{-4}$ Torr, about $5\times10^{-5}$). In some aspects, the ion guide chamber can be maintained at a pressure such that pressure×length of the quadrupole rods is greater than $2.25\times10^{-2}$ Torr-cm.

In accordance with various aspects, the step of applying a substantially identical auxiliary electrical signal to each of the auxiliary electrodes can comprise applying a DC voltage to each of the plurality of electrodes that is different from a DC offset voltage at which the quadrupole rod set is maintained. In related aspects, for example, the method can further comprise adjusting the DC voltage provided to the auxiliary electrodes so as to attenuate ions transmitted from the multipole ion guide (e.g., to reduce the ion current) and/or to adjust a m/z range of ions transmitted from the multipole ion guide. In some aspects, the method can further comprise preventing transmission through the exit aperture of ions received by the multipole ion guide by adjusting at least one of the first RF voltage provided to the first pair of rods, the second RF voltage applied to the second pair of rods, and the DC voltage provided to the auxiliary electrodes.

In accordance with various aspects of the present teachings, applying a substantially identical auxiliary electrical signal to each of the auxiliary electrodes can comprise applying an RF signal at a third frequency (e.g., different from the first frequency) and in a third phase. In related aspects, both an RF signal and a DC voltage different from a DC offset voltage at which the quadrupole rod set is maintained can be applied as the auxiliary electric signal.

In various aspects, the method can also comprise applying a supplemental electrical signal to at least one of the rods of the quadrupole rod set, the supplemental electrical signal being one of a DC voltage and an AC excitation signal. By way of example, the supplemental electrical signal applied to the quadrupole rod can be effective to additionally generate a dipolar DC field, a quadrupolar DC field, or resonance excitation using a supplementary AC field that is resonant or nearly resonant with some of the ions in the ion beam.

In some aspects, the auxiliary electrical signal applied to the auxiliary electrodes can be selected so as to promote the de-clustering of ions being transmitted through the multipole ion guide.

These and other features of the applicant's teaching are set forth herein.

BRIEF DESCRIPTION OF THE DRAWINGS

The foregoing and other objects and advantages of the invention will be appreciated more fully from the following further description, with reference to the accompanying drawings. The skilled person in the art will understand that the drawings, described below, are for illustration purposes only. The drawings are not intended to limit the scope of the applicant's teachings in any way.

DETAILED DESCRIPTION

It will be appreciated that for clarity, the following discussion will explicate various aspects of embodiments of the applicant's teachings, while omitting certain specific details wherever convenient or appropriate to do so. For example, discussion of like or analogous features in alternative embodiments may be somewhat abbreviated. Well-known ideas or concepts may also for brevity not be discussed in any great detail. The skilled person will recognize that some embodiments of the applicant's teachings may not require certain of the specifically described details in every implementation, which are set forth herein only to provide a thorough understanding of the embodiments. Similarly it will be apparent that the described embodiments may be susceptible to alteration or variation according to common general knowledge without departing from the scope of the disclosure. The following detailed description of embodiments is not to be regarded as limiting the scope of the applicant's teachings in any manner.

The term "about" and "substantially identical" as used herein, refers to variations in a numerical quantity that can occur, for example, through measuring or handling procedures in the real world; through inadvertent error in these procedures; through differences/faults in the manufacture of electrical elements; through electrical losses; as well as variations that would be recognized by one skilled in the art as being equivalent so long as such variations do not encompass known values practiced by the prior art. Typically, the term "about" means greater or lesser than the value or range of values stated by 1/10 of the stated value, e.g., ±10%. For instance, applying a voltage of about +3V DC to an element can mean a voltage between +2.7V DC and +3.3V DC. Likewise, wherein values are said to be "substantially identical," the values may differ by up to 5%. Whether or not modified by the term "about" or "substantially" identical, quantitative values recited in the claims include equivalents to the recited values, e.g., variations in the numerical quantity of such values that can occur, but would be recognized to be equivalents by a person skilled in the art.

Figure 1:
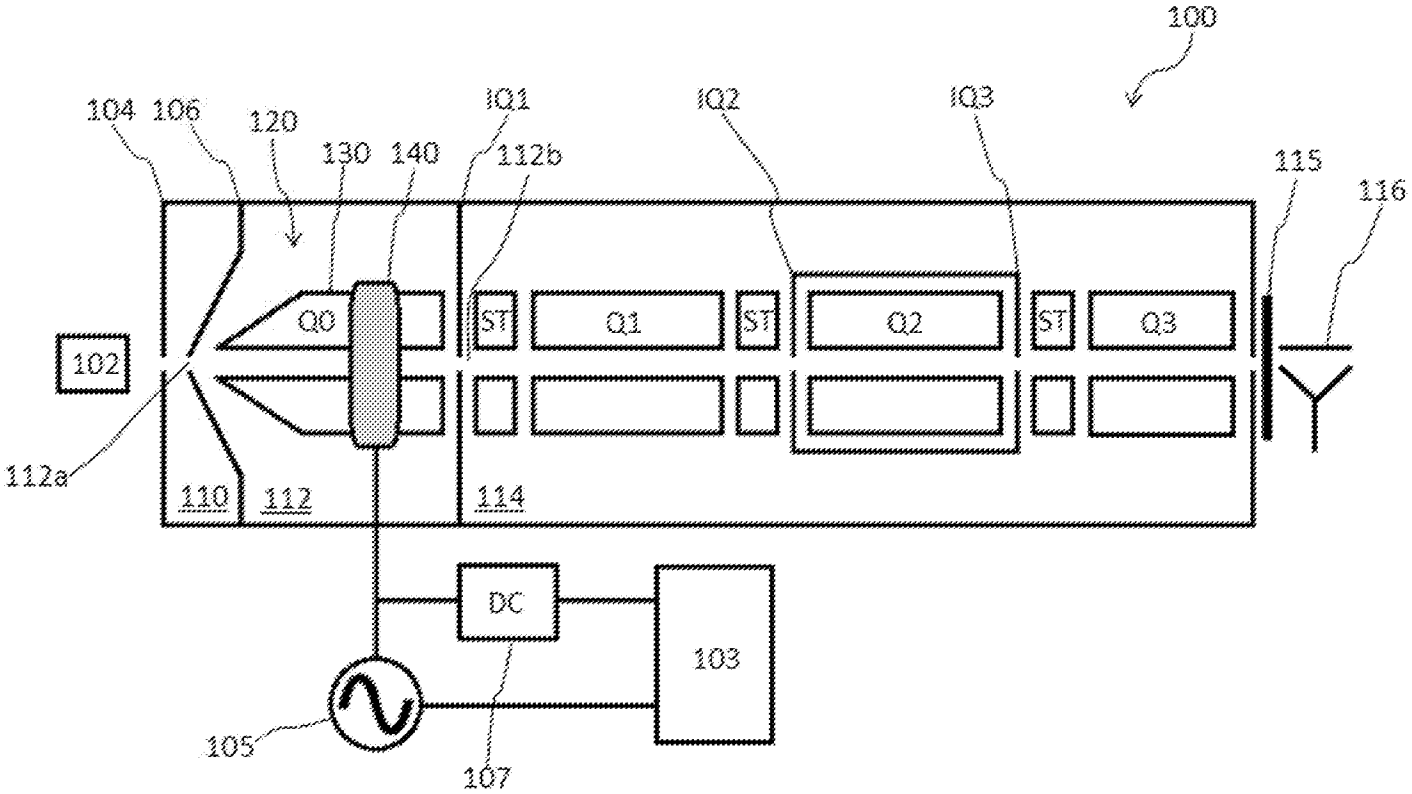
FIG. 1, in a schematic diagram, illustrates a QTRAP® QqQ mass spectrometer system that includes a multipole ion guide comprising auxiliary electrodes in accordance with one aspect of various embodiments of the applicant's teachings.

While the systems, devices, and methods described herein can be used in conjunction with many different mass spectrometer systems, an exemplary mass spectrometer system 100 for such use is illustrated schematically in FIG. 1. It should be understood that the mass spectrometer system 100 represents only one possible mass spectrometer instrument for use in accordance with embodiments of the systems, devices, and methods described herein, and mass spectrometers having other configurations can all be used in accordance with the systems, devices and methods described herein as well.

As shown schematically in the exemplary embodiment depicted in FIG. 1, the mass spectrometer system 100 generally comprises a QTRAP® Q-q-Q hybrid linear ion trap mass spectrometer, as generally described in an article entitled "Product ion scanning using a Q-q-$Q_{linear}$ ion trap (Q TRAP®) mass spectrometer," authored by James W. Hager and J. C. Yves Le Blanc and published in Rapid Communications in Mass Spectrometry (2003; 17: 1056-1064), which is hereby incorporated by reference in its entirety, and modified in accordance with various aspects of the present teachings. Other non-limiting, exemplary mass spectrometers systems that can be modified in accordance with the systems, devices, and methods disclosed herein can be found, for example, in U.S. Pat. No. 7,923,681, entitled "Collision Cell for Mass Spectrometer," which is hereby incorporated by reference in its entirety. Other configurations, including but not limited to those described herein and others known to those skilled in the art, can also be utilized in conjunction with the systems, devices, and methods disclosed herein.

As shown in FIG. 1, the exemplary mass spectrometer system 100 can comprise an ion source 102, a multipole ion guide 120 (i.e., Q0) housed within a first vacuum chamber 112, one or more mass analyzers housed within a second vacuum chamber 114, and a detector 116. It will be appreciated that though the exemplary second vacuum chamber 114 houses three mass analyzers (i.e., elongated rod sets Q1, Q2, and Q3 separated by orifice plates IQ2 between Q1 and Q2, and IQ3 between Q2 and Q3), more or fewer mass analyzer elements can be included in systems in accordance with the present teachings. For convenience, the elongated rod sets Q1, Q2, and Q3 are generally referred to herein as quadrupoles (that is, they have four rods), though the elongated rod sets can be any other suitable multipole configurations, for example, hexapoles, octapoles, etc. It will also be appreciated that the one or more mass analyzers can be any of triple quadrupoles, linear ion traps, quadrupole time of flights, Orbitrap or other Fourier transform mass spectrometers, all by way of non-limiting example.

As shown in FIG. 1, the exemplary mass spectrometer system 100 can additionally include one or more power supplies (e.g., RF power supply 105 and DC power supply 107) that can be controlled by a controller 103 so as to apply electric potentials with RF, AC, and/or DC components to the quadrupole rods, the various lenses, and the auxiliary electrodes to configure the elements of the mass spectrometer system 100 for various different modes of operation depending on the particular MS application. It will be appreciated that the controller 103 can also be linked to the various elements in order to provide joint control over the executed timing sequences. Accordingly, the controller can be configured to provide control signals to the power source(s) supplying the various components in a coordinated fashion in order to control the mass spectrometer system 100 as otherwise discussed herein.

Q0, Q1, Q2, and Q3 can be disposed in adjacent chambers that are separated, for example, by aperture lenses IQ1, IQ2, and IQ3, and are evacuated to sub-atmospheric pressures as is known in the art. By way of example, a mechanical pump (e.g., a turbo-molecular pump) can be used to evacuate the vacuum chambers to appropriate pressures. An exit lens 115 can be positioned between Q3 and the detector 116 to control ion flow into the detector 116. In some embodiments, a set of stubby rods can also be provided between neighboring pairs of quadrupole rod sets to facilitate the transfer of ions between quadrupoles. The stubby rods can serve as a Brubaker lens and can help minimize interactions with any fringing fields that may have formed in the vicinity of an adjacent lens, for example, if the lens is maintained at an offset potential. By way of non-limiting example, FIG. 1 depicts stubby rods ST between IQ1 and Q1 to focus the flow of ions into Q1. Similarly, stubby rods ST are included upstream and downstream of the elongated rod set Q2, for example.

The ion source 102 can be any known or hereafter developed ion source for generating ions and modified in accordance with the present teachings. Non-limiting examples of ion sources suitable for use with the present teachings include atmospheric pressure chemical ionization (APCI) sources, electrospray ionization (ESI) sources, continuous ion source, a pulsed ion source, an inductively coupled plasma (ICP) ion source, a matrix-assisted laser desorption/ionization (MALDI) ion source, a glow discharge ion source, an electron impact ion source, a chemical ionization source, or a photo-ionization ion source, among others.

During operation of the mass spectrometer 100, ions generated by the ion source 102 can be extracted into a coherent ion beam by passing successively through apertures in an orifice plate 104 and a skimmer 106 (i.e., inlet orifice 112*a*) to result in a narrow and highly focused ion beam. In various embodiments, an intermediate pressure chamber 110 can be located between the orifice plate 104 and the skimmer 106 that can be evacuated to a pressure approximately in the range of about 1 Torr to about 4 Torr, though other pressures can be used for this or for other purposes. In some embodiments, the ions can traverse one or more additional vacuum chambers and/or quadrupoles (e.g., a QJet® quadrupole or other RF ion guide) to provide additional focusing of and finer control over the ion beam using a combination of gas dynamics and radio frequency fields.

Ions generated by the ion source 102 are transmitted through the inlet orifice 112*a* to enter the multipole ion guide 120 (i.e., Q0), which in accordance with the present teachings, can be operated to transmit a portion of the ions received from the ion source 102 into the downstream mass analyzers for further processing, while preventing unwanted ions (e.g., interfering/contaminating ions, high-mass ions) from being transmitted into the lower pressures of the vacuum chamber 114. For example, in accordance with various aspects of the present teachings and as discussed in detail below, the multipole ion guide 120 can comprise a quadrupole rod set 130 and a plurality of auxiliary electrodes 140 extending along a portion of the multipole ion guide 120 and interposed between the rods of the quadrupole rod set 130 such that upon application of various RF and/or DC potentials to the components of the multipole ion guide 120, ions of interest are collisionally cooled (e.g., in conjunction with the pressure of vacuum chamber 112) and transmitted through the exit aperture 112*b* into the downstream mass analyzers for further processing, while unwanted ions can be neutralized within the multipole ion guide 120, thereby reducing a potential source of contamination and/or interference in downstream processing steps. The vacuum chamber 112, within which the multipole ion guide 120 is housed, can be associated with a mechanical pump (not shown) operable to evacuate the chamber to a pressure suitable to provide collisional cooling. For example, the vacuum chamber can be evacuated to a pressure approximately in the range of about 1 mTorr to about 10 mTorr, though other pressures can be used for this or for other purposes. For example, in some aspects, the vacuum chamber 112 can be maintained at a pressure such that pressure×length of the quadrupole rods is greater than $2.25\times10^{-2}$ Torr-cm. A lens IQ1 (e.g., an orifice plate) can be disposed between the vacuum chamber of Q0 and the adjacent chamber to isolate the two chambers 112, 114.

After being transmitted from Q0 through the exit aperture 112*b* of the lens IQ1, the ions can enter the adjacent quadrupole rod set Q1, which can be situated in a vacuum chamber 114 that can be evacuated to a pressure that can be maintained lower than that of ion guide chamber 112. By way of non-limiting example, the vacuum chamber 114 can be maintained at a pressure less than about $1\times10^{-4}$ Torr (e.g., about $5\times10^{-5}$ Torr), though other pressures can be used for this or for other purposes. As will be appreciated by a person of skill in the art, the quadrupole rod set Q1 can be operated as a conventional transmission RF/DC quadrupole mass filter that can be operated to select an ion of interest and/or a range of ions of interest. By way of example, the quadrupole rod set Q1 can be provided with RF/DC voltages suitable for operation in a mass-resolving mode. As should be appreciated, taking the physical and electrical properties of Q1 into account, parameters for an applied RF and DC voltage can be selected so that Q1 establishes a transmission window of chosen m/z ratios, such that these ions can traverse Q1 largely unperturbed. Ions having m/z ratios falling outside the window, however, do not attain stable trajectories within the quadrupole and can be prevented from traversing the quadrupole rod set Q1. It should be appreciated that this mode of operation is but one possible mode of operation for Q1. By way of example, the lens IQ2 between Q1 and Q2 can be maintained at a much higher offset potential than Q1 such that the quadrupole rod set Q1 be operated as an ion trap. In such a manner, the potential applied to the entry lens IQ2 can be selectively lowered (e.g., mass selectively scanned) such that ions trapped in Q1 can be accelerated into Q2, which could also be operated as an ion trap, for example.

Ions passing through the quadrupole rod set Q1 can pass through the lens IQ2 and into the adjacent quadrupole rod set Q2, which as shown can be disposed in a pressurized compartment and can be configured to operate as a collision cell at a pressure approximately in the range of from about 1 mTorr to about 10 mTorr, though other pressures can be used for this or for other purposes. A suitable collision gas (e.g., nitrogen, argon, helium, etc.) can be provided by way of a gas inlet (not shown) to thermalize and/or fragment ions in the ion beam. In some embodiments, application of suitable RF/DC voltages to the quadrupole rod set Q2 and entrance and exit lenses IQ2 and IQ3 can provide optional mass filtering.

Ions that are transmitted by Q2 can pass into the adjacent quadrupole rod set Q3, which is bounded upstream by IQ3 and downstream by the exit lens 115. As will be appreciated by a person skilled in the art, the quadrupole rod set Q3 can be operated at a decreased operating pressure relative to that of Q2, for example, less than about $1\times10^{-4}$ Torr (e.g., about $5\times10^{-5}$ Torr), though other pressures can be used for this or for other purposes. As will be appreciated by a person skilled in the art, Q3 can be operated in a number of manners, for example as a scanning RF/DC quadrupole or as a linear ion trap. Following processing or transmission through Q3, the ions can be transmitted into the detector 116 through the exit lens 115. The detector 116 can then be operated in a manner known to those skilled in the art in view of the systems, devices, and methods described herein. As will be appreciated by a person skill in the art, any known detector, modified in accord with the teachings herein, can be used to detect the ions.

Figure 2:
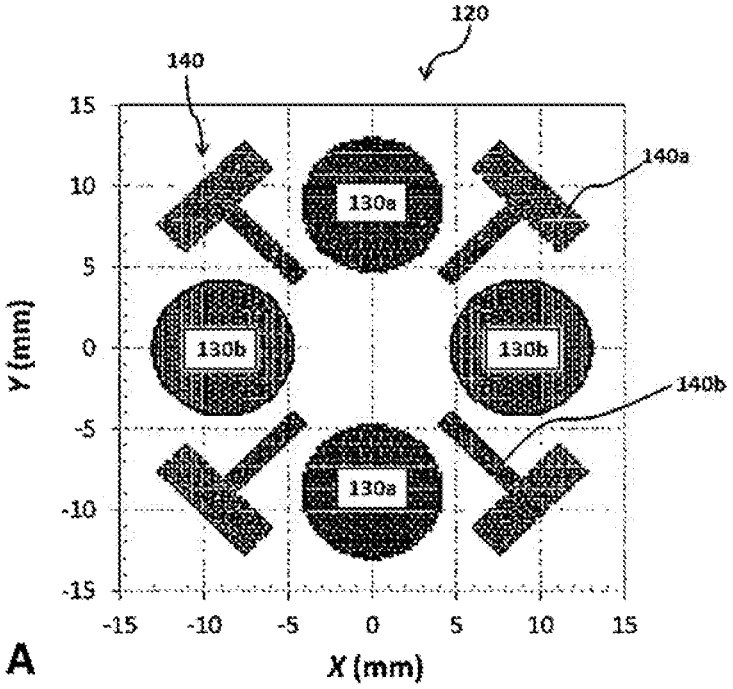
FIG. 2, in schematic diagram, depicts a cross-sectional view of an exemplary multipole ion guide in accordance with various aspects of the present teachings for use in the mass spectrometer system of FIG. 1.
Figure 3:
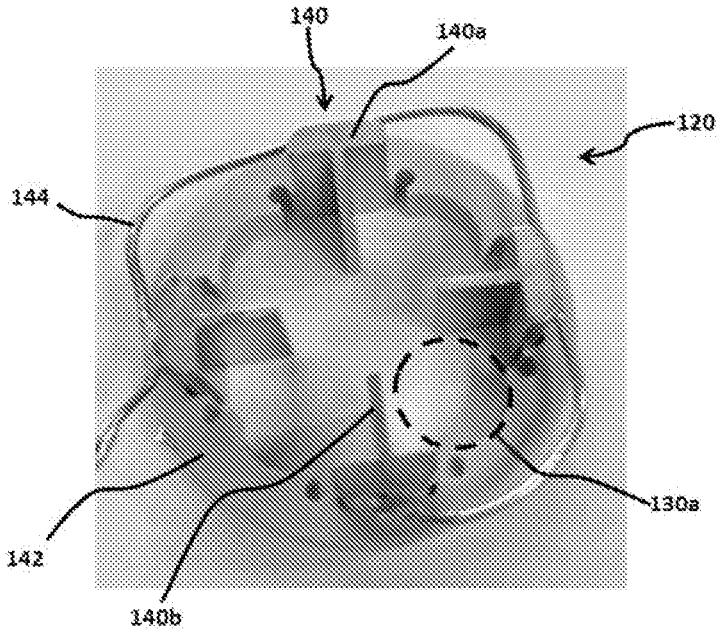
FIG. 3 depicts an exemplary prototype of a portion of the multipole ion guide of FIG. 2.

Referring now to FIGS. 2 and 3, the exemplary multipole ion guide 120 of FIG. 1 is depicted in more detail. First, with respect to FIG. 2, the multipole ion guide is 120 is depicted in cross-sectional schematic view across the location of the auxiliary electrodes 140 depicted in FIG. 1. As shown and noted above, the multipole ion guide 120 generally comprises a set of four rods 130*a,b* that extend from a proximal, inlet end disposed adjacent the inlet orifice 112*a* to a distal, outlet end disposed adjacent the exit aperture 112*b*. The rods 130*a,b* surround and extend along the central axis of the ion guide 120, thereby defining a space through which the ions are transmitted. As is known in the art, each of the rods 130*a,b* that form the quadrupole rod set 130 can be coupled to an RF power supply such that the rods on opposed sides of the central axis together form a rod pair to which a substantially identical RF signal is applied. That is, the rod pair 130*a* can be coupled to a first RF power supply that provides a first RF voltage to the first pair of rods 130*a* at a first frequency and in a first phase. On the other hand, the rod pair 130*b* can be coupled to a second RF power supply that provides a second RF voltage at a second frequency (which can be the same as the first frequency), but opposite in phase to the RF signal applied to the first pair of rods 130*a*. As will be appreciated by a person skilled in the art, a DC offset voltage can also be applied to the rods 130*a,b* of the quadrupole rod set 130.

As shown in FIG. 2, the multipole ion guide 120 additionally includes a plurality of auxiliary electrodes 140 interposed between the rods of the quadrupole rod set 130 that also extend along the central axis. As shown in FIG. 2, each auxiliary electrode 140 can be separated from another auxiliary electrode 140 by a rod 130*a,b* of the quadrupole rod set 130. Further, each of the auxiliary electrodes 140 can be disposed adjacent to and between a rod 130*a* of the first pair and a rod 130*b* of the second pair. As will be discussed in detail below, each of the auxiliary electrodes 140 can be coupled to an RF and/or DC power supply (e.g., power supplies 105 and 107 of FIG. 1) for providing an auxiliary electrical signal to the auxiliary electrodes 140 so as to control or manipulate the transmission of ions from the multipole ion guide 120 as otherwise described herein. By way of non-limiting example, in one embodiment, a DC voltage equal to the DC offset voltage applied to the rods of the quadrupole rod set 130*a,b* can be applied to the auxiliary electrodes 140. It should be appreciated that such an equivalent DC voltage applied to the auxiliary electrodes 140 would have substantially no effect on the radial forces experienced by the ions in the multipole ion guide 120 such that the multipole ion guide would function as a conventional collimating quadrupole ion guide. Alternatively, in accordance with various aspects of the present teachings, while the rods 130*a,b* of the quadrupole rod set 130 are maintained at a DC offset voltage with a first RF voltage applied to the first pair of rods 130*a* at a first frequency and in a first phase and a second RF voltage (e.g., of the same amplitude ($V_{0\text{-}p}$) as the first RF voltage) at a second frequency but opposite in phase applied to the second pair of rods 130*b*, a variety of auxiliary electrical signals can be applied to the auxiliary electrodes 140, including i) a DC voltage different than the DC offset voltage, but without an RF component; ii) an RF signal at a third amplitude and frequency (e.g., different than the first frequency) and in a third phase, while the DC voltage is equivalent to the DC offset voltage; and iii) both a DC voltage different than the DC offset voltage and an RF signal at a third amplitude and frequency and in a third phase, all by way of non-limiting example. Moreover, it will be appreciated that the auxiliary RF and/or DC signals applied to the auxiliary electrodes 140 in accordance with various aspects of the present teachings can be combined with other techniques known in the art utilized to increase the radial amplitudes of ions in a quadrupole ion guide. Such exemplary techniques include a dipolar DC application, quadrupolar DC application, and resonance excitation using a supplementary AC signal applied to the rods of the quadrupole, the AC signal being resonant or nearly resonant with some of the ions in the ion beam, all by way of non-limiting example.

It will be appreciated in light of the present teachings that the auxiliary electrodes 140 can have a variety of configurations. By way of example, the auxiliary electrodes 140 can have a variety of shapes (e.g., round, T-shaped), though T-shaped electrodes can be preferred as the extension of the stem 140*b* toward the central axis of the ion guide 120 from the rectangular base 140*a* allows the innermost conductive surface of the auxiliary electrode to be disposed closer to the central axis (e.g., to increase the strength of the field within the ion guide 120). In various aspects, the T-shaped electrodes can have a substantially constant cross section along their length such that the innermost radial surface of the stem 140*b* remains at a substantially constant distance from the central axis along the entire length of the auxiliary electrodes 140. Round auxiliary electrodes (or rods of other cross-sectional shapes) can also be used in accordance with various aspects of the present teachings, but would generally exhibit a smaller cross-sectional area relative to the quadrupole rods 130*a,b* due to the limited space between the quadrupole rods 130*a,b* and/or require the application of larger auxiliary potentials due to their increased distance from the central axis.

As noted above, the auxiliary electrodes 140 need not extend along the entire length of the quadrupole rods 130*a,b*. For example, the auxiliary electrodes 140 can have a length less than half of the length of the quadrupole rod set 130 (e.g., less than 33%, less than 10%). Whereas the rod electrodes of a conventional Q0 quadrupole can have a length along the longitudinal axis in a range from about 10 cm to about 30 cm, the auxiliary electrodes 140 can have a length of 10 mm, 25 mm, or 50 mm, all by way of non-limiting example. Moreover, though FIG. 1 depicts the auxiliary electrodes 140 disposed about halfway between the proximal and distal ends of the quadrupole rod set 130, auxiliary electrodes 140 can be positioned more proximal or more distal relative to this depicted exemplary embodiment. By way of example, the auxiliary electrodes 140 can be disposed at any of the proximal third, the middle third, or the distal third of the quadrupole rod set 130. Indeed, because of the relatively shorter length of auxiliary electrodes 140, it will be appreciated that the quadrupole rod set 130*a,b* can accommodate multiple sets of auxiliary electrodes 140 at various positions along the central axis. By way of example, it is within the scope of the present teachings that the mass spectrometer system 100 can include a first, proximal set of auxiliary electrodes to which a first auxiliary electrical signal can be applied (e.g., a DC voltage different from the DC offset voltage of rods 130*a,b*) and one or more distal sets of auxiliary electrodes to which a second auxiliary electrical signal can be applied (e.g., having an RF component).

With reference now to FIG. 3, a portion of an exemplary prototype of ion guide 120 is depicted. As shown in FIG. 3, the ion guide 120 comprises four T-shaped electrodes 140 having a base portion 140*a* and a stem portion 140*b* extending therefrom. The electrodes 140, which are 10 mm in length and have a stem 140*b* approximately 6 mm in length, can be coupled to a mounting ring 142 that can be mounted to a desired location of the quadrupole rod set 130, in accordance with various aspects of the present teachings. By way of non-limiting example, the exemplary mounting ring 142 comprises notches for securely engaging the rods of the quadrupole rod set 130 (e.g., as with quadrupole 130*a*, shown in phantom). As shown, a single lead 144, which can be coupled to an RF power supply 105 and/or DC power supply 107, can also be electrically coupled to each of the auxiliary electrodes 140 such that a substantially identical auxiliary electrical signal is applied to each of the auxiliary electrodes 140.

EXAMPLES

As noted above, a variety of RF and/or DC signals can be applied to the auxiliary electrodes 140 so as to control or manipulate the transmission of ions from the multipole ion guide 120 into the downstream vacuum chamber 114 in accordance with the present teachings. The above teachings will now be demonstrated using the following examples, provided to demonstrate but not limit the present teachings, in which i) a DC voltage (without an RF component) different than the DC offset voltage applied to the rods 130*a,b* is applied to the exemplary auxiliary T-shaped electrodes 140 of FIG. 2; ii) an RF signal is applied to the exemplary auxiliary T-shaped electrodes 140 of FIG. 2 (the DC voltage applied to electrodes 140 is equivalent to the DC offset voltage); and iii) both a DC voltage different than the DC offset voltage applied to the rods 130*a,b* and an RF signal are applied to the exemplary auxiliary T-shaped electrodes 140 of FIG. 2.

Figure 4A:
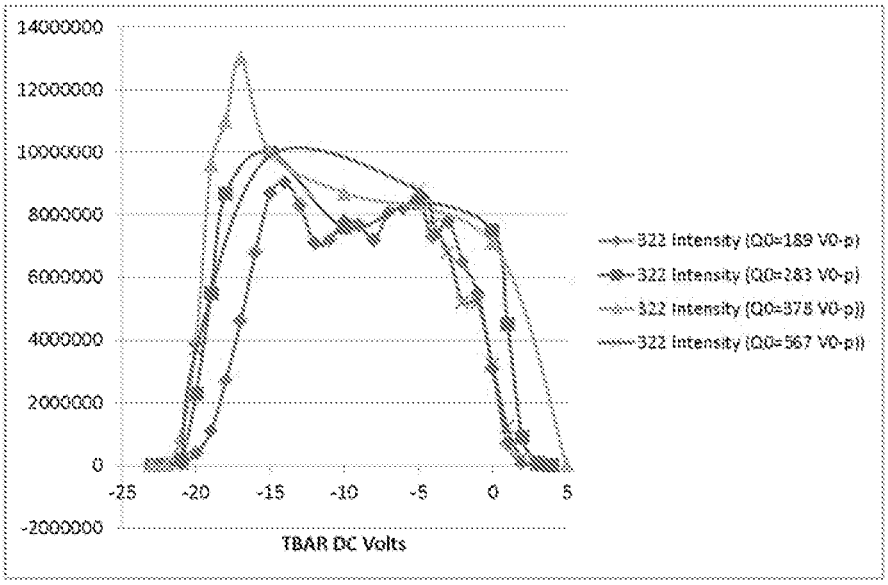
FIG. 4A depicts exemplary data for an ion having a m/z of 322 Da processed by a mass spectrometer system in accordance with various aspects of the present teachings.
Figure 4B:
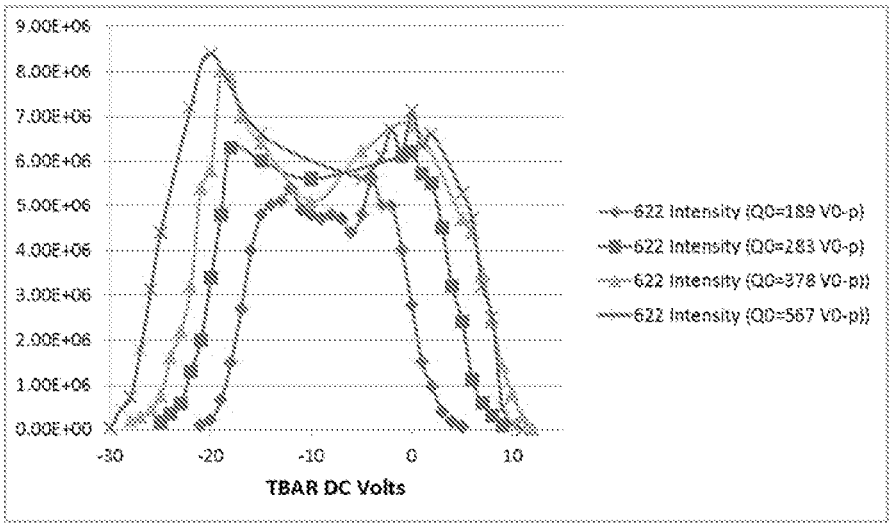
FIG. 4B depicts exemplary data for an ion having a m/z of 622 Da processed by a mass spectrometer system in accordance with various aspects of the present teachings.
Figure 4C:
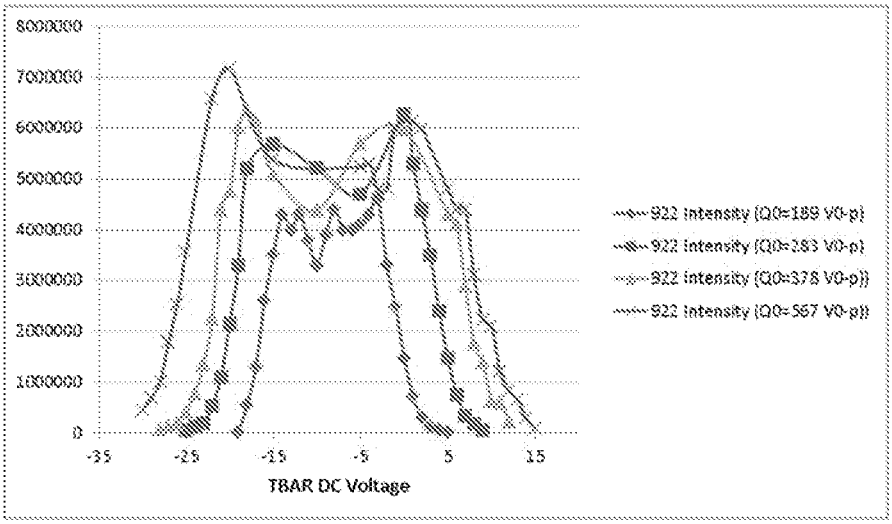
FIG. 4C depicts exemplary data for an ion having a m/z of 922 Da processed by a mass spectrometer system in accordance with various aspects of the present teachings.

With reference first to FIGS. 4A-C, exemplary data is depicted demonstrating the transmission of various ions through a 4000 QTRAP® System (marketed by SCIEX) modified in accordance with the present teachings to include auxiliary T-shaped electrodes 140 having a length of about 50 mm located about 12 cm downstream from the proximal, inlet end of the quadrupole rods of Q0 (which have a length of about 18 cm). The quadrupole rods of Q0 were maintained at a −10V DC offset, with various RF signals of different amplitudes (i.e., 189 $V_{0\text{-}p}$, 283 $V_{0\text{-}p}$, 378 $V_{0\text{-}p}$, and 567 $V_{0\text{-}p}$) being applied to the quadrupole rods. The main drive RF applied to the quadrupole rods was approximately 1 MHz, with the signals applied to adjacent quadrupole rods being opposite in phase to one another.

FIGS. 4A-C depict the change in transmission of ions exhibiting a m/z of 322 Da, 622 Da, and 922 Da, respectively, through the multipole ion guide as the DC voltage applied to the auxiliary electrodes is adjusted away from the DC offset voltage (i.e., −10V DC). For example, with specific reference now to FIG. 4A, transmission of ions having a m/z of 322 Da is substantially stopped at an auxiliary DC voltage of about ±10-15V DC from the DC offset voltage (i.e., at about −18-22V DC and +12-15V DC) for each of the various RF signals applied to the quadrupole rods. As shown in FIGS. 4B and 4C, however, the DC cutoff for ions of increased m/z varies substantially depending on the amplitude of the RF applied to the quadrupole rods (generally, as $V_{0\text{-}p}$ increases, increasingly higher auxiliary DC voltages are required to stop transmission of ions through the multipole ion guide). By way of example, for ions having a m/z of 922 Da, the cutoff is approximately at ±10V DC from the DC offset voltage (i.e., at −20V DC and 0V DC) at 189 $V_{0\text{-}p}$, while at 567 $V_{0\text{-}p}$ the cutoff is approximately ±25V DC from the DC offset voltage (i.e., at −35V DC and +15V DC). In light of these examples, it will be appreciated that the RF voltages applied to the quadrupole rod sets and/or the auxiliary DC signal can be adjusted (e.g., via controller 103) so as to substantially prohibit transmission of all ions to the downstream mass analyzers. By way of non-limiting example, the auxiliary DC voltages can be adjusted away from the DC offset voltage beyond the cutoff point of substantially all ions generated by the ion source. The above data also indicates that the amplitude of the RF signal applied to the quadrupole rods can be decreased separately, or simultaneously in conjunction with the increase of the difference between the auxiliary DC voltage and the DC offset voltage, so as to prevent transmission of ions through the multipole ion guide. Accordingly, methods and systems in accordance with the present teachings can stop the flow of ions into the downstream mass analyzers (e.g., further reducing contamination), for example, during periods of times when it is known that analytes are not present in a sample being delivered to a continuous ion source (e.g. at early or late parts of the gradient elution of a liquid chromatograph) and/or when a downstream mass analyzer (e.g., an ion trapping device) is processing ions previously transmitted through the ion guide.

With continued reference to FIGS. 4A-C, it should be appreciated that at an auxiliary DC voltage of about −10V DC, the electric field within the ion guide would not be substantially altered by the auxiliary DC voltage such that the multipole ion guide would function as a conventional collimating quadrupole (i.e., as if the auxiliary electrodes were not even present). Though methods and systems in accordance with various aspects of the present teachings can be effective to reduce the transmission of unwanted ions (e.g., interfering/contaminating ions of high m/z as discussed otherwise herein and with specific respect to FIGS. 5A-C below), FIGS. 4A-C surprisingly demonstrate that the overall ion transmission through the ion guide can be increased relative to a conventional collimating quadrupole as the auxiliary DC signal is adjusted away from the DC offset voltage. That is, as shown in FIGS. 4A-C, the overall detected ion current is initially increased by the auxiliary DC voltages relative to the ion current generated when the auxiliary DC voltage is maintained at the DC offset voltage. Without being bound by any particular theory, it is believed that this increase in ion current can be attributed to the increased de-clustering of ions within the ion guide caused by the auxiliary DC signal. Whereas these heavy, charged clusters may be neutralized in a conventional collimating quadrupole Q0 and/or contaminate downstream optical elements and mass analyzers following transmission through Q0 into a downstream vacuum chamber, methods and systems in accordance with various aspects of the present teachings can surprisingly be used to de-cluster these charged clusters within the ion guide, thereby liberating ions therefrom and potentially increasing sensitivity by allowing for transmission/detection of the ions of interest that are typically lost in conventional systems.

Figures 5A, 5B, 5C:
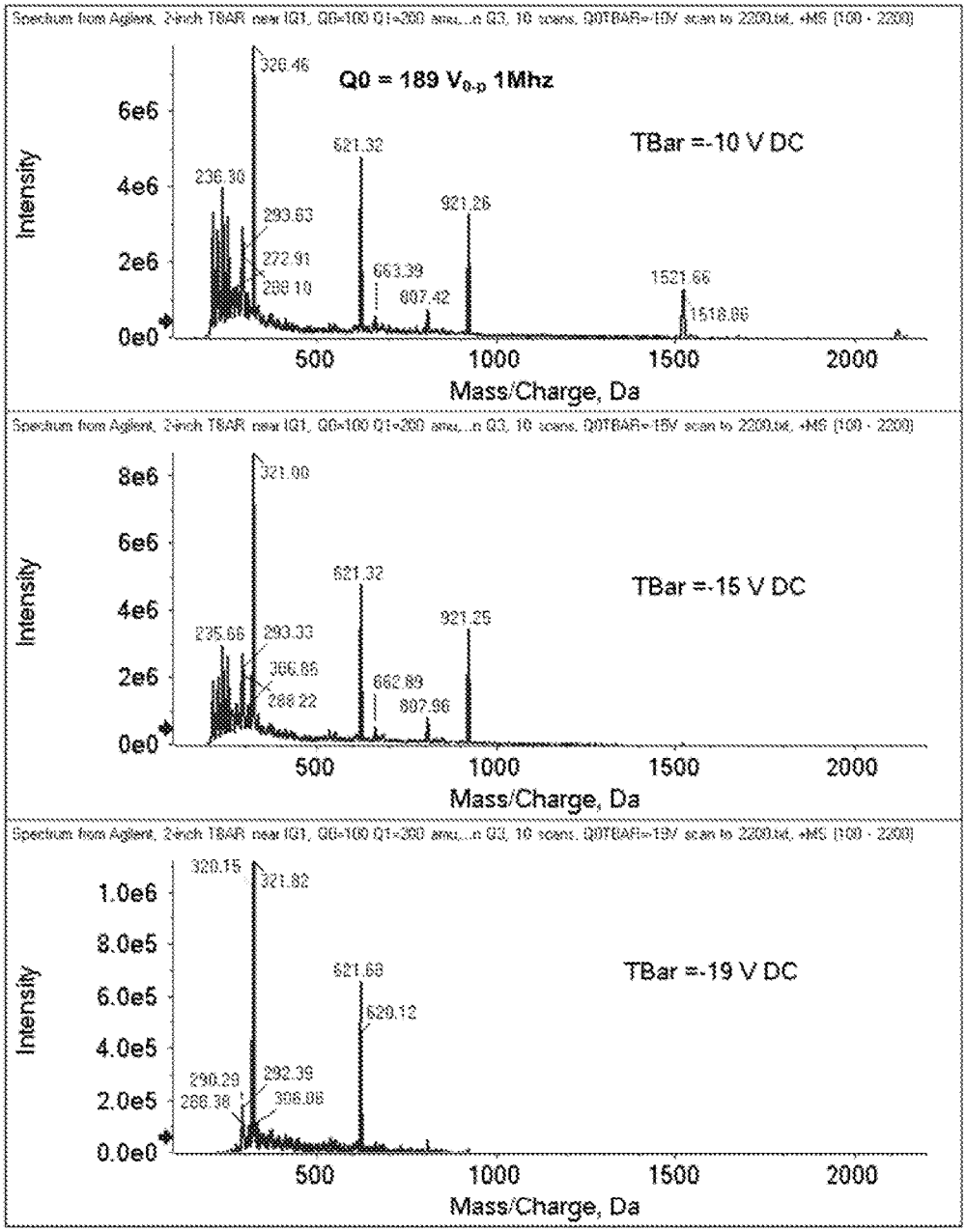
FIGS. 5A-C depict exemplary mass spectra generated by a mass spectrometer system for processing ions in accordance with various aspects of the present teachings.
Figure 6A:
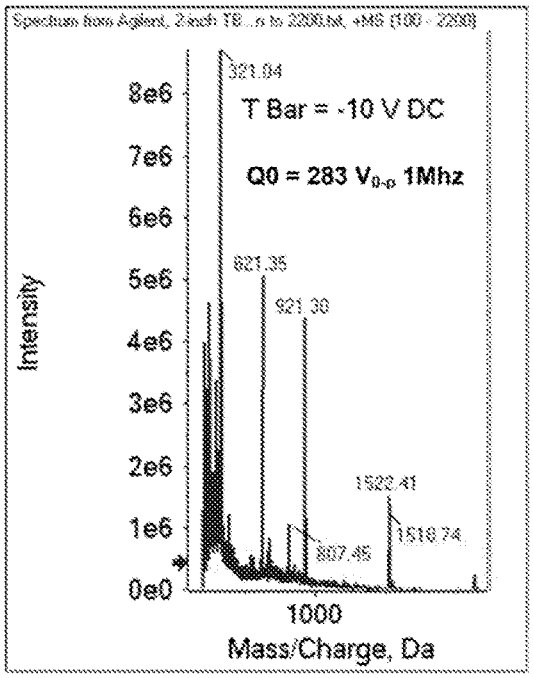
FIGS. 6A-D depict exemplary mass spectra generated by a mass spectrometer system for processing ions in accordance with various aspects of the present teachings.
Figure 6B:
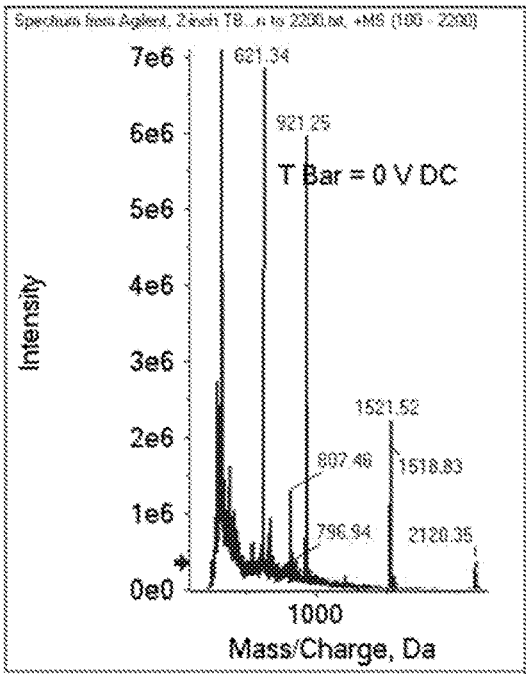
Figure 6C:
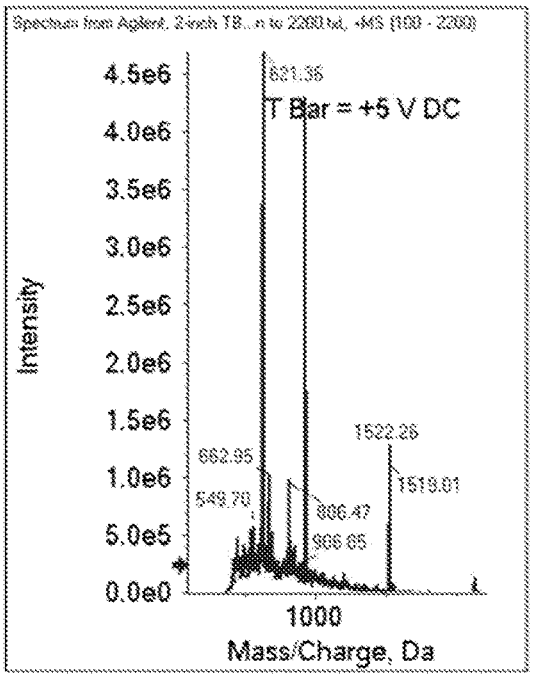
Figure 6D:
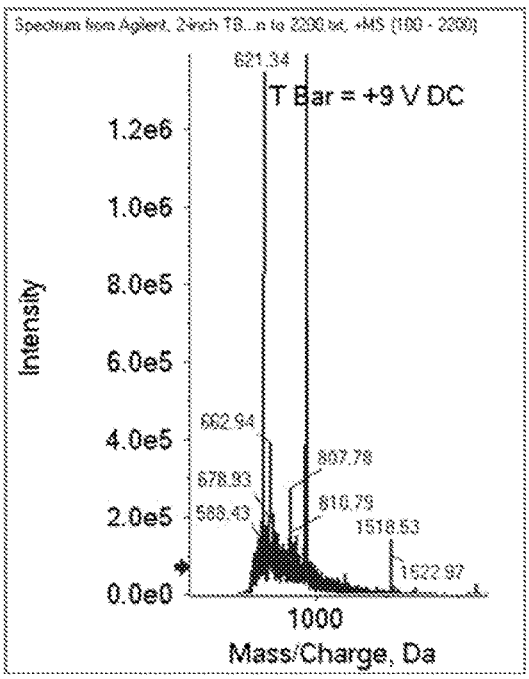

With reference now to FIGS. 5A-C, exemplary mass spectra are depicted following transmission of an ionized standard (Agilent ESI Tuning Mix, G2421!, Agilent Technologies) through a 4000 QTRAP® System modified in accordance with various aspects of the present teachings to include auxiliary T-shaped electrodes having a length of about 50 mm located about 12 cm downstream from the proximal, inlet end of the quadrupole rods of Q0 (which have a length of about 18 cm). The quadrupole rods of Q0 were maintained at a −10V DC offset, with an RF signal of 189 $V_{0-p}$ being applied to the quadrupole rods. The main drive RF applied to the quadrupole rods was approximately 1 MHz, with the signals applied to adjacent quadrupole rods being opposite in phase to one another.

To generate the mass spectrogram of FIG. 5A, the auxiliary electrodes were maintained at −10V DC (i.e., at the same DC offset voltage of quadrupole rods) such that the ion guide substantially functioned as a conventional collimating quadrupole. For FIG. 5B, the auxiliary DC voltage was adjusted away from the DC offset voltage by decreasing the voltage of the auxiliary rods to −15V DC (ΔV=−5V DC relative to DC offset). That is, compared to the quadrupole rods, the auxiliary electrodes were 5V more attractive to the positive ions generated by the ion source. To obtain the spectrogram of FIG. 5C, the auxiliary DC voltage was further decreased to −19V DC (ΔV=−9V DC). No RF signal was applied to the auxiliary electrodes.

Comparing FIG. 5B to FIG. 5A, it can be observed that by adjusting (in this case decreasing, making the auxiliary electrodes more attractive to positive ions) the auxiliary DC voltage relative to the DC offset voltage, that the configuration of FIG. 5B was effective to filter high m/z ions. For example, while identifiable peaks are present in FIG. 5A at 1518.86 Da and 1521.66 Da, these peaks are absent from FIG. 5B. Indeed, there is no discernible signal in FIG. 5B at m/z greater than about 1400 Da.

In comparing FIG. 5C to FIG. 5B, it is observed that by further decreasing the auxiliary DC voltage relative to the DC offset voltage, the high m/z ions are further filtered. For example, while an identifiable peak is present in FIG. 5B at 921.25 Da, this peak is absent in FIG. 5C. Indeed, there is no discernible signal in FIG. 5C beyond about 900 Da. It should also be noted that increased filtering of low m/z ions can also be observed in comparing FIG. 5C to FIG. 5B, though this effect is less pronounced than the high-pass filter effect. For example, an identifiable peak present in FIG. 5B at 235.66 Da is absent in FIG. 5C. It will thus be appreciated that ion guides in accordance with various aspects of the present teachings can be operated as a low-pass filter (as in FIG. 5B) and/or as a bandpass filter (as in FIG. 5C) by adjusting the auxiliary DC signal, thereby potentially preventing interfering/contaminating ions from being transmitted to downstream mass analyzers.

With reference now to FIGS. 6A-D, exemplary mass spectra are depicted following transmission of an ionized standard (Agilent ESI Tuning Mix, G2421!, Agilent Technologies) through a 4000 QTRAP® System modified substantially as described above with reference to FIGS. 5A-C. To obtain the mass spectra of FIGS. 6A-D, however, an RF signal of 283 $V_{0-p}$ was applied to the quadrupole rods (still maintained at a −10V DC offset). The experimental conditions of FIGS. 6A-D further differs in that rather than decreasing the voltage (i.e., making the auxiliary DC signal more negative relative to the −10V DC offset), the auxiliary DC voltage was adjusted away from the DC offset voltage by increasing the voltage of the auxiliary rods to 0V DC as in FIG. 6B (ΔV=10V DC relative to DC offset), +5V DC as in FIG. 6C (ΔV=+15V DC), and +9V DC as in FIG. 6D (ΔV=+19V DC). That is, compared to the quadrupole rods, the auxiliary electrodes were more repulsive to positive ions generated by the ion source. Comparing FIGS. 6A-6D, the ion guides appear to better filter low m/z ions as the auxiliary electrodes become increasingly positive (i.e., more repulsive to positive ions) relative to the quadrupole electrodes. It will thus be appreciated that ion guides in accordance with various aspects of the present teachings can be operated as a high-pass filter by making the auxiliary DC signal more positive, thereby potentially preventing interfering/contaminating low m/z ions from being transmitted to downstream mass analyzers.

Figures 7A, 7B, 7C:
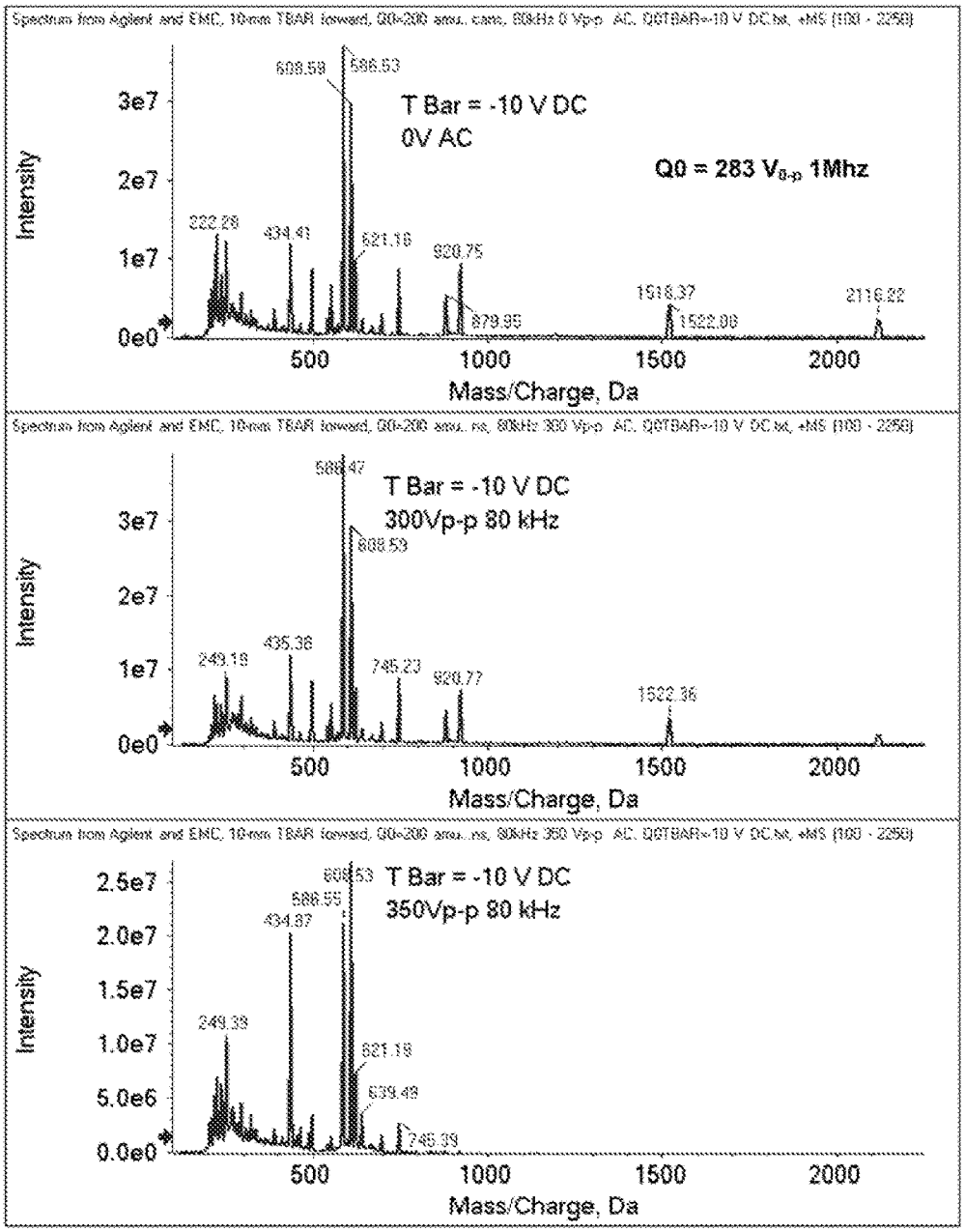
FIGS. 7A-C depict exemplary mass spectra generated by a mass spectrometer system for processing ions in accordance with various aspects of the present teachings.

In accordance with various aspects, ion guides in accordance with the present teachings can alternatively or additionally be coupled to an RF power supply such that an RF signal is applied to the auxiliary electrodes so as to control or manipulate the transmission of ions from the multipole ion guide 120 into the downstream vacuum chamber 114. With reference now to FIGS. 7A-C, exemplary mass spectra are depicted following transmission of an ionized standard (Agilent ESI Tuning Mix, G2421!, Agilent Technologies) through a 4000 QTRAP® System modified in accordance with various aspects of the present teachings to include auxiliary T-shaped electrodes having a length of about 10 mm located about 12 cm downstream from the proximal, inlet end of the quadrupole rods of Q0 (which have a length of about 18 cm). The quadrupole rods of Q0 were maintained at a −10V DC offset, with an RF signal of 283 $V_{0-p}$ being applied to the quadrupole rods. The main drive RF applied to the quadrupole rods was approximately 1 MHz, with the signals applied to adjacent quadrupole rods being opposite in phase to one another.

To generate the mass spectrogram of FIG. 7A, the auxiliary electrodes were maintained at −10V DC (i.e., at the same DC offset voltage of quadrupole rods) such that the ion guide substantially functioned as a conventional collimating quadrupole (i.e., no auxiliary RF signal was applied). For FIG. 7B, the auxiliary DC voltage was also maintained at −10V DC, though an identical auxiliary RF signal was applied to each of the auxiliary electrodes (e.g. the four electrodes 140 of FIGS. 2 and 3) at 300 $V_{p-p}$ at a frequency of 80 kHz. Similarly, for FIG. 7C, the auxiliary DC voltage was maintained at −10V DC and an identical auxiliary RF signal was applied to each of the auxiliary electrodes at 350 $V_{p-p}$ at a frequency of 80 kHz. In comparing FIGS. 7A-C, it is observed that the increasing the amplitude of the RF signal applied to the auxiliary electrodes can be increasingly effective to remove high m/z ions from the mass spectrum, with little to no effect on the low m/z portion of the spectrum. For example, while identifiable peaks are present in FIG. 7A at 2116.22 Da, this peak is largely attenuated in FIG. 7B. In comparing FIG. 7C to FIG. 7B (after increasing the amplitude of the auxiliary RF signal to 350 $V_{p-p}$ from 300 $V_{p-p}$), it is observed that high m/z ions are further filtered. For example, while identifiable peaks are present in FIG. 7B at 920.77 Da and 1522.36 Da, these peaks are absent in FIG. 7C. Indeed, there is no discernible signal in FIG. 7C beyond about 900 Da. It will thus be appreciated that in ion guides in accordance with various aspects of the present teachings, the RF signal applied to the auxiliary electrodes can be adjusted to prevent high m/z ions from being transmitted to downstream mass analyzers, thereby potentially preventing the effects of interfering/contaminating ions present in the ions generated by ion source.

Figure 8A:
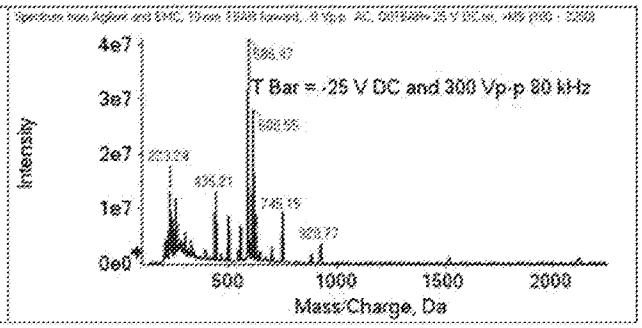
FIGS. 8A-F depict exemplary mass spectra generated by a mass spectrometer system for processing ions in accordance with various aspects of the present teachings.
Figure 8B:
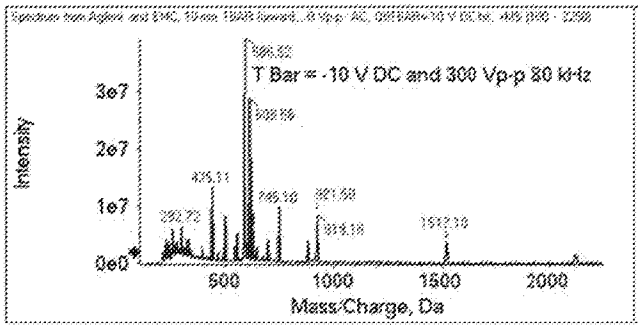
Figure 8C:
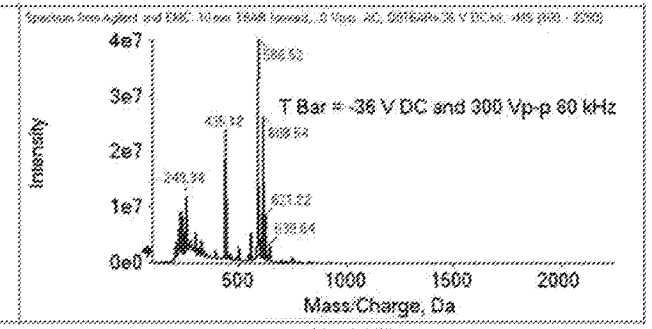
Figure 8D:
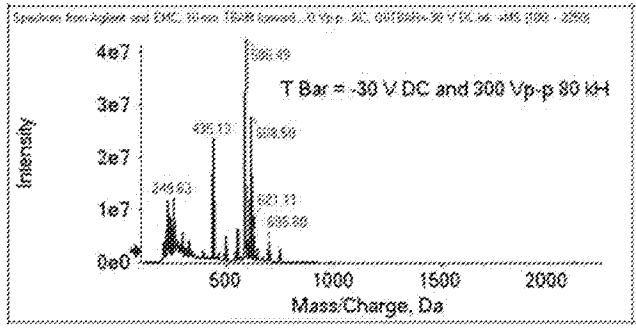
Figure 8E:
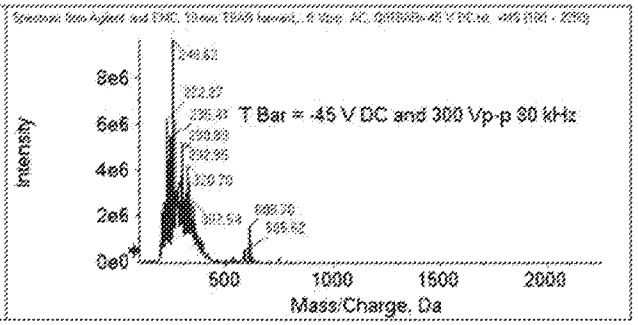
Figure 8F:
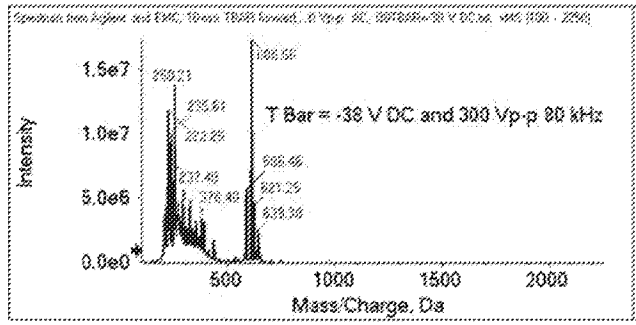

Further, in accordance with various aspects of the present teachings, both the auxiliary DC signal and auxiliary RF signal applied to the auxiliary electrodes can be adjusted so as to control or manipulate the transmission of ions from the multipole ion guide. With reference now to FIG. 7A and FIGS. 8A-F, the exemplary mass spectra depict the effect of adjustments to both the DC and RF auxiliary signals. As noted above, to generate the mass spectrogram of FIG. 7A, the auxiliary electrodes were maintained at −10V DC (i.e., at the same DC offset voltage of quadrupole rods) such that the ion guide substantially functioned as a conventional collimating quadrupole (i.e., no auxiliary RF signal was applied). In FIG. 8A (which is identical to FIG. 7B), the auxiliary DC voltage was maintained at −10V DC, though an identical auxiliary RF signal at 300 $V_{p-p}$ at a frequency of 80 kHz was applied to each of the auxiliary electrodes. For the ion spectra of FIGS. 8B-E, the auxiliary RF signal was maintained at 300 $V_{p-p}$ at a frequency of 80 kHz, while the auxiliary DC voltage applied to the electrodes was respectively decreased as follows: −25V DC as in FIG. 8B (ΔV=−15V DC relative to DC offset); −30V DC as in FIG. 8C (ΔV=−20V DC); −36V DC as in FIG. 8D (ΔV=−26V DC); −38V DC as in FIG. 8E (ΔV=−28V DC); and −45V DC as in FIG. 8F (ΔV=−35V DC). It will be appreciated by a person skilled in the art in light of the accompanying data and the present teachings that both the RF and DC auxiliary signals can be adjusted (e.g., tuned) so as to provide the desired filtering by ion guides in accordance with various aspects described herein. By way of non-limiting example, it will be appreciated that the data of FIG. 8A-F demonstrate that the application of the RF signal can reduce the amplitude of the auxiliary DC voltage required for filtering of the high m/z ions, while the low m/z ions remain largely unaffected (compare FIG. 5C which depicts substantial low m/z removal at an auxiliary DC voltage of −19V DC (ΔV=−9V DC relative to DC offset)).

Those skilled in the art will know or be able to ascertain using no more than routine experimentation, many equivalents to the embodiments and practices described herein. By way of example, the dimensions of the various components and explicit values for particular electrical signals (e.g., amplitude, frequencies, etc.) applied to the various components are merely exemplary and are not intended to limit the scope of the present teachings. Accordingly, it will be understood that the invention is not to be limited to the embodiments disclosed herein, but is to be understood from the following claims, which are to be interpreted as broadly as allowed under the law.

The section headings used herein are for organizational purposes only and are not to be construed as limiting. While the applicant's teachings are described in conjunction with various embodiments, it is not intended that the applicant's teachings be limited to such embodiments. On the contrary, the applicant's teachings encompass various alternatives, modifications, and equivalents, as will be appreciated by those of skill in the art.

The invention claimed is:

1. A mass spectrometer system, comprising:

an ion source for generating ions;

an ion guide chamber, the ion guide chamber comprising an inlet orifice for receiving the ions generated by the ion source and at least one exit aperture for transmitting ions from the ion guide chamber into a vacuum chamber housing at least one mass analyzer;

a multipole ion guide disposed in the ion guide chamber, the multipole ion guide comprising:

i) a quadrupole rod set extending from a proximal end disposed adjacent the inlet orifice to a distal end disposed adjacent the exit aperture, the quadrupole rod set comprising a first pair of rods and a second pair of rods, wherein each rod is spaced from and extends alongside a central longitudinal axis, and ii) a plurality of auxiliary electrodes spaced from and extending alongside the central longitudinal axis along less than about half of the length of the quadrupole rod set, the plurality of auxiliary electrodes interposed between the rods of the quadrupole rod set such that the auxiliary electrodes are separated from one another by a rod of the quadrupole rod set and such that each of the auxiliary electrodes is adjacent to a single rod of the first pair of rods and a single rod of the second pair of rods, wherein the plurality of auxiliary electrodes comprise a substantially constant cross section along their length, and a power supply coupled to the multipole ion guide operable to provide i) a first RF voltage to the first pair of rods at a first frequency and in a first phase, ii) a second RF voltage to the second pair of rods at a second frequency equal to the first frequency and in a second phase opposite to the first phase, iii) an auxiliary electrical signal to each of the auxiliary electrodes, wherein the auxiliary electrical signal applied to each of the auxiliary electrodes is substantially identical, and at least one of an auxiliary RF voltage source operable to provide an RF voltage to the auxiliary electrodes and an auxiliary DC voltage operable to provide a DC voltage to the auxiliary electrodes to prevent transmission of high m/z ions.

2. The mass spectrometer system of claim 1, wherein the auxiliary electrical signal comprises a DC voltage different from a DC offset voltage at which the quadrupole rod set is maintained.

3. The mass spectrometer system of claim 2, further comprising a controller configured to adjust the DC voltage provided to the auxiliary electrodes so as to attenuate ions transmitted from the multipole ion guide.

4. The mass spectrometer system of claim 2, further comprising a controller configured to adjust the DC voltage provided to the auxiliary electrodes so as to adjust a m/z range of ions transmitted from the multipole ion guide.

5. The mass spectrometer system of claim 2, further comprising a controller configured to adjust at least one of the first RF voltage provided to the first pair of rods, the second RF voltage applied to the second pair of rods, and the DC voltage provided to the auxiliary electrodes such that substantially no ions are transmitted through the exit aperture into the vacuum chamber.

6. The mass spectrometer system of claim 1, wherein the auxiliary electrical signal comprises an RF signal at a third frequency and in a third phase.

7. The mass spectrometer system of claim 6, wherein the auxiliary electrical signal further comprises a DC voltage different from a DC offset voltage at which the quadrupole rod set is maintained.

8. The mass spectrometer system of claim 1, wherein the power supply is further operable to provide a supplemental electrical signal to at least one of the rods of the quadrupole rod set, the supplemental electrical signal being one of a DC voltage and an AC excitation signal.

9. The mass spectrometer system of claim 1, wherein the system further comprising a second set of auxiliary electrodes axially offset from the first set of auxiliary electrodes, and wherein the power supply is operable to provide a substantially identical second auxiliary electrical signal to each of the second set of auxiliary electrodes, wherein the second auxiliary electrical signal is different from the auxiliary signal provided to the first set of auxiliary electrodes.

10. A method of processing ions, comprising:

receiving ions generated by an ion source through an inlet orifice of an ion guide chamber;

transmitting ions through a multipole ion guide disposed in the ion guide chamber, the multipole ion guide comprising:

i) a quadrupole rod set extending from a proximal end disposed adjacent the inlet orifice to a distal end disposed adjacent an exit aperture of the ion guide chamber, the quadrupole rod set comprising a first pair of rods and a second pair of rods, wherein each rod is spaced from and extends alongside a central longitudinal axis, and ii) a plurality of auxiliary electrodes spaced from and extending alongside the central longitudinal axis along less than about half of the length of the quadrupole rod set, the plurality of auxiliary electrodes interposed between the rods of the quadrupole rod set such that the auxiliary electrodes are separated from one another by a rod of the quadrupole rod set and such that each of the auxiliary electrodes is adjacent to a single rod of the first pair of rods and a single rod of the second pair of rods;

wherein the plurality of auxiliary electrodes comprise a substantially constant cross section along their length;

applying a first RF voltage to the first pair of rods at a first frequency and in a first phase;

applying a second RF voltage to the second pair at a second frequency equal to the first frequency and in a second phase opposite to the first phase;

applying a substantially identical auxiliary electrical signal to each of the auxiliary electrodes;

applying at least one of an RF voltage to the auxiliary electrodes and a DC voltage to the auxiliary electrodes to prevent transmission of high m/z ions; and transmitting ions from the multipole ion guide through the exit aperture into a vacuum chamber housing at least one mass analyzer.

11. The method of claim 10, further comprising maintaining the ion guide chamber at a pressure in a range from about 1 mTorr to about 10 mTorr.

12. The method of claim 10, wherein applying a substantially identical auxiliary electrical signal to each of the auxiliary electrodes comprises applying a DC voltage to the auxiliary electrodes that is different from a DC offset voltage at which the quadrupole rod set is maintained.

13. The method of claim 12, further comprising adjusting the DC voltage provided to the auxiliary electrodes so as to attenuate ions transmitted from the multipole ion guide.

14. The method of claim 13, further comprising adjusting the DC voltage provided to the auxiliary electrodes so as to adjust a m/z range of ions transmitted from the multipole ion guide.

15. The method of claim 13, further comprising adjusting at least one of the first RF voltage provided to the first pair of rods, the second RF voltage applied to the second pair of rods, and the DC voltage provided to the auxiliary electrodes to stop transmission of ions through the exit aperture into the vacuum chamber.

16. The method of claim 10, wherein applying a substantially identical auxiliary electrical signal to each of the auxiliary electrodes comprises applying an RF signal at a third frequency and in a third phase.

17. The method of claim 16, wherein applying a substantially identical auxiliary electrical signal to each of the auxiliary electrodes further comprises applying a DC voltage to the auxiliary electrodes different from a DC offset voltage at which the quadrupole rod set is maintained.

18. The method of claim 10, further comprising applying a supplemental electrical signal to at least one of the rods of the quadrupole rod set, the supplemental electrical signal being one of a DC voltage and an AC excitation signal.

19. The method of claim 10, wherein the auxiliary electrical signal applied to each of the auxiliary electrodes is selected so as to promote the de-clustering of ions being transmitted through the multipole ion guide.

* * * * *